US010276010B2

(12) United States Patent
Lee

(10) Patent No.: US 10,276,010 B2
(45) Date of Patent: Apr. 30, 2019

(54) APPARATUS AND METHOD FOR ALARM SERVICE USING USER STATUS RECOGNITION INFORMATION IN ELECTRONIC DEVICE

(71) Applicant: Samsung Electronics Co., Ltd., Gyeonggi-do (KR)

(72) Inventor: Keun-Cheol Lee, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/114,026

(22) PCT Filed: Oct. 21, 2014

(86) PCT No.: PCT/KR2014/009864
§ 371 (c)(1),
(2) Date: Jul. 25, 2016

(87) PCT Pub. No.: WO2015/111824
PCT Pub. Date: Jul. 30, 2015

(65) Prior Publication Data

US 2016/0343225 A1 Nov. 24, 2016

(30) Foreign Application Priority Data

Jan. 24, 2014 (KR) ..... 10-2014-0009155

(51) Int. Cl.
*G08B 21/00* (2006.01)
*G08B 17/06* (2006.01)
*G08B 25/10* (2006.01)

(52) U.S. Cl.
CPC ..... *G08B 17/06* (2013.01); *G08B 25/10* (2013.01)

(58) Field of Classification Search
CPC .... G08B 17/06; G08B 25/10; G07C 9/00309; G07C 2009/00769; G07C 2009/00928;
(Continued)

(56) References Cited

U.S. PATENT DOCUMENTS 6,420,969 B1 * 7/2002 Campbell ..... G08B 25/008 307/139
7,327,246 B2 * 2/2008 Schoor ..... G08B 29/24 340/3.1

(Continued)

FOREIGN PATENT DOCUMENTS

CN 1673915 9/2005
CN 101833309 9/2010

(Continued)

OTHER PUBLICATIONS

PCT/ISA/237 Written Opinion issued on PCT/KR2014/009864 (pp. 7).

(Continued)

*Primary Examiner* — Kerri L McNally
*Assistant Examiner* — Thang D Tran
(74) *Attorney, Agent, or Firm* — The Farrell Law Firm, P.C.

(57) ABSTRACT

The present disclosure relates to a sensor network, Machine Type Communication (MTC), Machine-to-Machine (M2M) communication, and technology for Internet of Things (IoT). The present disclosure may be applied to intelligent services based on the above technologies, such as smart home, smart building, smart city, smart car, connected car, health care, digital education, smart retail, security and safety services. A method and an apparatus for alarm service using user status recognition information in an electronic device is provided. The method of electronic device includes determining a rule for eliminating a fire danger of at least one device capable of communicating with the electronic device, determining the fire danger of the at least one device based on the rule, and if the fire danger exists, notifying the fire danger to a user.

18 Claims, 9 Drawing Sheets

(58) Field of Classification Search
CPC ..... E05F 15/00; H04W 4/021; H04W 4/04; E05Y 2900/106
USPC ..... 340/635
See application file for complete search history.

(56) References Cited

U.S. PATENT DOCUMENTS

2003/0090374 A1* 5/2003 Quigley ..... G08B 19/005 340/506
2003/0234725 A1* 12/2003 Lemelson ..... G08B 7/066 340/521
2004/0003073 A1* 1/2004 Krzyzanowski .... H04L 12/2803 709/223
2005/0033527 A1* 2/2005 Wada ..... G01D 3/08 702/35
2006/0044106 A1* 3/2006 Hirose ..... H04L 12/2805 340/3.54
2006/0058900 A1* 3/2006 Johanson ..... G05B 15/02 700/83
2006/0164253 A1* 7/2006 Harvey ..... G08B 17/10 340/628
2006/0232431 A1* 10/2006 Shirlee ..... F24C 3/12 340/628
2007/0030161 A1* 2/2007 Yang ..... F24C 7/08 340/679
2007/0103290 A1* 5/2007 Kroupa ..... G08B 25/14 340/521
2007/0210913 A1* 9/2007 Numazaki ..... G08B 25/009 340/521
2007/0241876 A1* 10/2007 Johnston ..... G08B 17/00 340/506
2008/0120868 A1* 5/2008 Morrison ..... D06F 58/04 34/572
2009/0195349 A1* 8/2009 Frader-Thompson ..... G01D 4/002 340/3.1
2009/0226155 A1* 9/2009 Cartwright ..... F24H 1/202 392/451
2010/0238019 A1* 9/2010 Richman ..... G08B 13/19656 340/521
2010/0262665 A1* 10/2010 Ouyang ..... H04L 12/1895 709/206
2010/0305773 A1* 12/2010 Cohen ..... H02J 3/14 700/296
2011/0185196 A1* 7/2011 Asano ..... B60L 11/1809 713/300
2011/0238234 A1* 9/2011 Chen ..... A62C 3/00 700/295
2012/0074789 A1* 3/2012 Yonezawa ..... G01D 4/00 307/84
2012/0079092 A1* 3/2012 Woxblom ..... H04L 47/20 709/223
2012/0132635 A1 5/2012 Mishra
2012/0287546 A1* 11/2012 Kopelman ..... H02H 5/045 361/105
2013/0100268 A1* 4/2013 Mihailidis ..... G08B 21/02 348/77
2013/0214935 A1 8/2013 Kim et al.
2013/0229278 A1* 9/2013 Davis ..... G08B 21/0484 340/521
2013/0260320 A1* 10/2013 Townsend ..... F24C 7/08 431/2
2013/0297259 A1* 11/2013 Tsao ..... G01D 4/004 702/188
2013/0334203 A1* 12/2013 Legatti ..... H05B 1/0261 219/509
2014/0098445 A1* 4/2014 Hooper ..... H02H 3/16 361/42
2014/0201315 A1* 7/2014 Jacob ..... H04L 12/2803 709/217
2014/0266669 A1* 9/2014 Fadell ..... G05B 19/042 340/501
2014/0340216 A1* 11/2014 Puskarich ..... G08B 17/11 340/539.11
2014/0365018 A1* 12/2014 Kusukame ..... G05D 23/1917 700/276
2015/0136430 A1* 5/2015 Livchak ..... F24C 15/2021 169/46
2015/0145677 A1* 5/2015 Smith, Jr. ..... G08B 21/182 340/540
2015/0228419 A1* 8/2015 Fadell ..... G08B 17/00 307/112

FOREIGN PATENT DOCUMENTS

CN 203299986 11/2013
KR 1020050026257 3/2005
KR 100592624 6/2006
KR 100826601 4/2008
KR 1020090008911 1/2009
KR 1020090036222 4/2009
KR 101261883 5/2013

OTHER PUBLICATIONS

PCT/ISA/210 Search Report issued on PCT/KR2014/009864 (pp. 3).
Chinese Office Action dated Dec. 13, 2018 issued in counterpart application No. 201480074023.5, 24 pages.

* cited by examiner

| 201 | | | | 203 | | | | | | | 205 | | | | |
|---|---|---|---|---|---|---|---|---|---|---|---|---|---|---|---|
| EXTERNAL CONDITION STATUS EXAMPLES | | | | FIRE HAZARD EQUIPMENT STATUS EXAMPLES | | | | | | | OTHER EQUIPMENT STATUS EXAMPLES | | | | |
| TEMPER -ATURE | WEA -THER | ELECTR -IC RATE | TIME | REFRIG -ERATOR | AIR CONDIT -IONER | WASHING MACHINE | DRYER | OVEN | TV | LED | SWITCH | DOOR LOCK | MOTION DETEC -TOR | IP CAMERA | DIGITAL THERMO -METER |
| WARM | CLEAR | HIGH | DAWN | ON | ON | ON | ON | ON | ON | ON | ON | DOOR OPENED | ON | ON | ON |
| MODER -ATE | CLOUDY | MEDIUM | MORN -ING | OFF | OFF | OFF | OFF | OFF | OFF | OFF | OFF | DOOR CLOSED | OFF | OFF | OFF |
| COLD | RAINY | LOW | NOON | REFRIG -ERATOR UNIT OPENED | HIGH TEMPER -ATURE | WASHING COMPLE -TED | DRYING COMPLE -TED | COOKING COMPLE -TED | CHAN -NEL | BRIGHT | | | MOTION DETEC -TED | MOTION DETEC -TED | HIGH TEMPER -ATURE |
| | SNOWY | | AFTER -NOON | REFRIG -ERATOR UNIT CLOSED | NORMAL TEMPER -ATURE | | | | | NORMAL | | | | SOUND DETEC -TED | NORMAL TEMPER -ATURE |
| | | | EVENING | FREEZER OPENED | LOW TEMPER -ATURE | | | | | DARK | | | | | LOW TEMPER -ATURE |
| | | | NIGHT | CLOSE REFRIGERATOR UNIT | | | | | | | | | | | |

FIG.2

301 303

| FIRE HAZARD EQUIPMENT OPERATION EXAMPLES | | | | | | | OTHER EQUIPMENT OPERATION EXAMPLES | | | | |
|---|---|---|---|---|---|---|---|---|---|---|---|
| REFRIG -ERATOR | AIR CONDIT -IONER | WASHING MACHINE | DRYER | OVEN | TV | LED | SWITCH | DOOR LOCK | MOTION DETECTOR | IP CAMERA | DIGITAL THERMOMETER |
| OPEN REFRIG -ERATOR UNIT | ON | ON | ON | ON | ON | ON | ON | OPEN DOOR | DETECT MOTION | DETECT MOTION | ON |
| OPEN FREEZER | OFF | OFF | OFF | OFF | OFF | OFF | OFF | CLOSE DOOR | | DETECT SOUND | OFF |
| CLOSE REFRIG -ERATOR UNIT | TEMPERATURE UP | | | | | BRIGHTEN | | | | SEND IMAGE | TEMPERATURE UP |
| CLOSE FREEZER | TEMPERATURE DOWN | | | | | DARKEN | | | | | TEMPERATURE DOWN |
| TEMPERATURE UP | | | | | | | | | | | |
| TEMPERATURE DOWN | | | | | | | | | | | |

FIG.3

APPARATUS AND METHOD FOR ALARM SERVICE USING USER STATUS RECOGNITION INFORMATION IN ELECTRONIC DEVICE

PRIORITY

This application is a National Phase Entry of PCT International Application No. PCT/KR2014/009864, which was filed on Oct. 21, 2014, and claims priority to Korean Patent Application No. 10-2014-0009155, which was filed on Jan. 24, 2014, the contents of each of which are incorporated herein by reference.

TECHNICAL FIELD

The present disclosure relates generally to automatic fire danger recognition and alarming in an electronic device.

BACKGROUND

The Internet, which is a human centered connectivity network where humans generate and consume information, is now evolving to the Internet of Things (IoT) where distributed entities, such as things, exchange and process information without human intervention. The Internet of Everything (IoE), which is a combination of the IoT technology and the Big Data processing technology through connection with a cloud server, has emerged. As technology elements, such as "sensing technology", "wired/wireless communication and network infrastructure", "service interface technology", and "Security technology" have been demanded for IoT implementation, a sensor network, a Machine-to-Machine (M2M) communication, Machine Type Communication (MTC), and so forth have been recently researched.

Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing Information Technology (IT) and various industrial applications.

A fire alarm system is a system which, in case of fire, rapidly sounds a fire alarm to proximate people, guides evacuation, and thus prevents loss of lives. The fire alarm system includes a manual fire alarm system which issues a fire alarm by manually manipulating a device with a user hand, and an automatic fire alarm system which automatically detects a fire and initiates signal transmission without human intervention. A smart home system provides convenience and efficiency to a user in a house in association with various devices such as a home appliance and a sensor.

Thanks to advances in electronics technology, numerous electric products using electricity are used indoors such as home, office, and factory. The electric products offer convenience and efficiency to the user. However, the electric products incur an electrical fire risk. The electrical fire increases annually all over the world, and accordingly property damage and casualty are sharply increasing. Although electric fire increases every year and awareness of fire prevention rises, fire prevention measures are still insufficient. When a source of a fire can be discovered and prevented before the fire breaks out, damages of property and life can be reduced in the fire. Hence, a method for notifying a fire danger prior to the fire outbreak and removing the fire danger is demanded.

SUMMARY

To address the above-discussed deficiencies of the prior art, it is a primary aspect of the present disclosure to provide an apparatus and a method for providing a fire danger warning in an electronic device.

Another aspect of the present disclosure is to provide an apparatus and a method for providing a fire danger warning according to an external condition in an electronic device.

Yet another aspect of the present disclosure is to provide an apparatus and a method for warning a fire danger using a terminal capable of communicating with a fire hazard equipment and controlling the fire hazard equipment in an electronic device.

Still another aspect of the present disclosure is to provide an apparatus and a method for warning a fire danger using a home network in an electronic device.

According to one aspect of the present disclosure, an operating method of an electronic device includes determining a rule for eliminating a fire danger of at least one equipment capable of communicating with the electronic device, determining a fire danger of the at least one equipment based on the rule, and when the fire danger exists, notifying the fire danger to a user.

According to another aspect of the present disclosure, an electronic device includes a control unit for determining a rule for eliminating a fire danger of at least one equipment capable of communicating with the electronic device, determining a fire danger of the at least one equipment based on the rule, and when the fire danger exists, notifying the fire danger to a user.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present disclosure will be more apparent from the following description taken in conjunction with the accompanying drawings, in which:

FIG. 2 depicts external condition and equipment statuses in a system according to an embodiment of the present disclosure;

FIG. 3 depicts operations of fire hazard equipments and other equipment in a system according to an embodiment of the present disclosure;

Throughout the drawings, like reference numerals will be understood to refer to like parts, components and structures.

DETAILED DESCRIPTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

Exemplary embodiments of the present disclosure provide a technique for recognizing and notifying a fire hazard equipment to a user in an electronics device.

Figure 1:
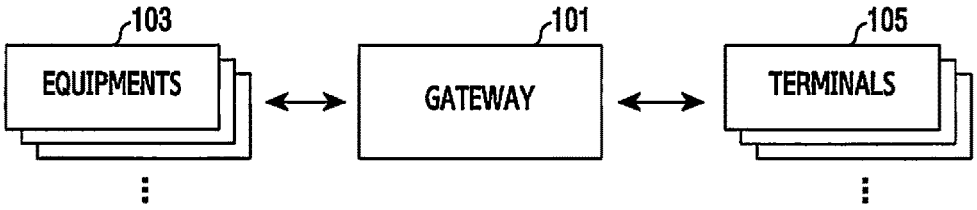
FIG. 1 depicts a system according to an embodiment of the present disclosure.

FIG. 1 depicts a system according to an embodiment of the present disclosure.

Referring to FIG. 1, the system includes a gateway 101, equipments 103, and terminals 105.

The gateway 101 indicates a device which serves an entrance from one network to another network. That is, the gateway 101 can be used to connect one network such as Local Area Network (LAN) with another network. Since networks can have different data transmission schemes, the gateway 101 is required. In other words, each network transmits data using a protocol distinguished from other network. When one network is directly connected to a network using a different protocol, data cannot be shared between the networks.

The equipments 103 indicate objects configuring a network in the system. The equipments 103 include a communication function. When a new use method (e.g., recipe, a method of washing) is added to a server connected with the equipments 103, the equipments 103 can download the new use method on line and upgrade a function. For example, a refrigerator includes not only a simple refrigerating and freezing function but also functions such as Internet shopping and food management. In addition, the equipments 103 include a door lock, an Internet Protocol (IP) camera, a Closed Circuit TeleVision (CCTV), a motion detector, a digital thermometer, a PhotoVoltaic (PV) system, an Energy Storage System (ESS), or the like. The equipments 103 can be controlled remotely from the outside. According to an embodiment of the present disclosure, whole or part of the equipments 103 can cause a fire. For example, whole or part of the equipments 103 can include a device having a heating function according to its purpose, a device used at a high temperature according its characteristics, a device which generates a heat according to a use status, and the like. The equipments 103 can include home appliances which can cause a fire due to electrical overload or gas, such as a refrigerator with a communication function, a washing machine, an oven, a vacuum cleaner, an air conditioner, a dishwasher, and a robot vacuum cleaner.

The terminals 105 are devices having a communication function for communicating with the equipments 103 over a network including the gateway 101. For example, the terminals 105 can include one of a smart phone, a portable terminal, a mobile phone, a mobile pad, a media player, a tablet computer, a handheld computer, a Personal Digital Assistant (PDA), a desktop computer, a smart TV, and can be a device combining two or more functions of the aforementioned device.

Although not shown in FIG. 1, the system can further include a remote server. The remote server indicates a communication server configured to access the network from a remote location. For example, through the remote server, in an enterprise, workers at branch offices, telecommuters, or workers on a business trip can access a headquarter network and, at home, a remote access using an Internet Service Provider (ISP) or an access to a modem of a desktop computer or a notebook via a line can be enabled. In addition, the remote server can use a leased line when an intra-communication network is configured with a remote location, and can use radio, cable modem, and fiber optic technologies.

According to an embodiment of the present disclosure, a fire danger of the equipments 103 can be predicted, and control for fire prevention can be performed. In this case, the prediction and the control of the fire danger can be executed by any one of the terminals 105, any one of the equipments 103, or the gateway 101. That is, any one of the terminals 105, any one of the equipments 103, or the gateway 101 can have a function for predicting and controlling the fire danger.

Hereinafter, a subject for executing the function for predicting and controlling the fire danger is referred to as an 'electronic device'. Also, hereinafter, an equipment which can cause a fire monitored and controlled by the electronic device is referred to as a 'fire hazard equipment'.

FIG. 2 depicts external condition and equipment statuses in a system according to an embodiment of the present disclosure.

Referring to FIG. 2, external condition status examples 201, fire hazard equipment status examples 203, and other equipment status examples 205 are shown.

Referring to FIG. 2, the external condition status examples 201 include statuses such as temperature, weather, electricity rate, and time.

The temperature status can be divided into warm, moderate, cold, and the like. The weather status can be divided into clear, cloudy, rainy, snowy, and the like. The electricity rate status can be divided into high, medium, low, and the like. The time status can be divided into dawn, morning, noon, afternoon, evening, night, and the like.

Referring to FIG. 2, the equipments can include the fire hazard equipments and other equipments. The fire hazard equipment includes statuses such as refrigerator, air conditioner, washing machine, dryer, oven, TV, and Liquid Emitted Diode (LED) light.

The refrigerator is a box-shaped device for cooling or storing food or medicine at a low temperature so as not to corrupt, includes a storage unit and a cooling device, and cools storage goods using ice, electricity, gas or the like. The air conditioner indicates a device for controlling a temperature and humidity of indoor air in summer. The washing machine indicates a machine for automating washing, rinsing, and draining by rotating a washtub using electric power. The dryer is a machine for drying a wet object, by evaporating moisture using heat or hot air or by mechanically extracting water. The oven represents devices for braking bread or cookies. The TV indicates a device showing images anywhere electric signal reaches. The LED light indicates a light using a light-emitting diode device.

The refrigerator status can be divided into ON, OFF, refrigerator unit opened, refrigerator unit closed, freezer opened, freezer closed, and so on. The air conditioner status can be divided into ON, OFF, high temperature, normal temperature, low temperature, and so on. The washing machine status can be divided into ON, OFF, washing completed, and so on. The dryer status can be divided into ON, OFF, drying completed, and so on. The oven status can be divided into ON, OFF, cooking completed, and so on. The TV status can be divided into ON, OFF, and so on. The LED status can be divided into ON, OFF, bright, normal, dark, and so on.

Referring to FIG. 2, the other equipment includes statuses such as a switch, a door lock, a motion detector, an IP camera, and a digital thermometer.

The switch is device for opening and closing an electric circuit or changing a connection status of the electric circuit, and used in addition to a light, a heater, and an electrical appliance in a normal building such as house or office. The door lock includes a physical door lock system including a mechanical device and a door lock system including an electronic device, a key type includes a classic key most common, a magnetic key, and a card key, and a door lock system without a separate key includes a door lock system which replaces the key with numbers and a cognitive door lock system which recognizes a fingerprint or an iris. The motion detector indicates a device for detecting movement of an object and notifying to a user terminal. The IP camera is a camera using wired/wireless Internet connection and includes a camera module, a decoder, a video compression chip, a Central Processing Unit (CPU), and a network transport chip. The IP camera can monitor a situation in a house using a mobile phone even from outside. The digital thermometer indicates an electronic thermometer and uses a tendency where electric resistance of an electric resistor of a resistor significantly decreases as a temperature rises.

The switch status can be divided to ON, OFF, and the like. The door lock status can be divided into door open, door closed, and the like. The motion detector status can be divided into ON, OFF, motion detected, and the like. The IP camera status can be divided to ON, OFF, motion detected, sound detected, and the like. The digital thermometer status can be divided to ON, OFF, high temperature, normal temperature, low temperature and the like.

According to an embodiment of the present disclosure, the fire hazard equipments and the other hazard equipments of the equipments of FIG. 2 include only the refrigerator, the air conditioner, the washing machine, the dryer, the oven, the TV, the LED, the switch, the door lock, the motion detector, the IP camera, and the digital thermometer. According to another embodiment of the present disclosure, examples of the fire hazard equipments and the other hazard equipments can vary.

FIG. 3 depicts operations of fire hazard equipments and other equipments in a system according to an embodiment of the present disclosure.

Referring to FIG. 3, fire hazard equipment operation examples 301 and other equipment operation examples 303 are shown.

Referring to FIG. 3, the fire hazard equipment includes operations of a refrigerator, an air conditioner, a washing machine, a dryer, an oven, a TV, and an LED.

The refrigerator is a box-shaped device for cooling or storing food or medicine at a low temperature so as not to corrupt, includes a storage and a cooling device, and cools storage goods using ice, electricity, gas, or the like. The air conditioner indicates a device for controlling a temperature and humidity of indoor air in summer. The washing machine indicates a machine for automating washing, rinsing, and draining by rotating a washtub using electric power. The dryer is a machine for drying a wet object, by evaporating moisture using heat or hot air or by mechanically extracting water. The oven represents devices for braking bread or cookies. The TV indicates a device showing images anywhere electric signal reaches. The LED light indicates a light using a light-emitting diode device.

The refrigerator operation can be divided into open refrigerator unit, close refrigerator unit, open freezer, close freezer, temperature up, temperature down, and so on. The air conditioner operation can be divided into ON, OFF, temperature up, temperature down, and so on. The washing machine operation can be divided into ON, OFF, and so on. The dryer operation can be divided into ON, OFF, and so on. The oven operation can be divided into ON, OFF, and so on. The TV operation can be divided into ON, OFF, and so on. The LED operation can be divided into ON, OFF, brighten, darken, and so on.

Referring to FIG. 3, the other equipment includes operations of a switch, a door lock, a motion detector, an IP camera, and a digital thermometer.

The switch is device for opening and closing an electric circuit or changing a connection status of the electric circuit, and used in addition to a light, a heater, and an electrical appliance in a normal building such as house or office. The door lock includes a physical door lock system including a mechanical device and a door lock system including an electronic device, a key type includes a classic key most common, a magnetic key, and a card key, and a door lock system without a separate key includes a door lock system which replaces the key with numbers and a cognitive door lock system which recognizes a fingerprint or an iris. The motion detector indicates a device for detecting movement of an object and notifying to a user terminal. The IP camera is a camera using wired/wireless Internet connection and includes a camera module, a decoder, a video compression chip, a CPU, and a network transport chip. The IP camera can monitor a situation in a house using a mobile phone even from outside. The digital thermometer indicates an electronic thermometer and uses a tendency where electric resistance of an electric resistor of a resistor significantly reduces as a temperature rises.

The switch operation can be divided to ON, OFF, and the like. The door lock operation can be divided into open door, close door, and the like. The motion detector operation can be divided into detect motion and the like. The IP camera operation can be divided to detect motion, detect sound, send image, and the like. The digital thermometer operation can be divided to ON, OFF, temperature up, temperature down, and the like.

Figure 4:
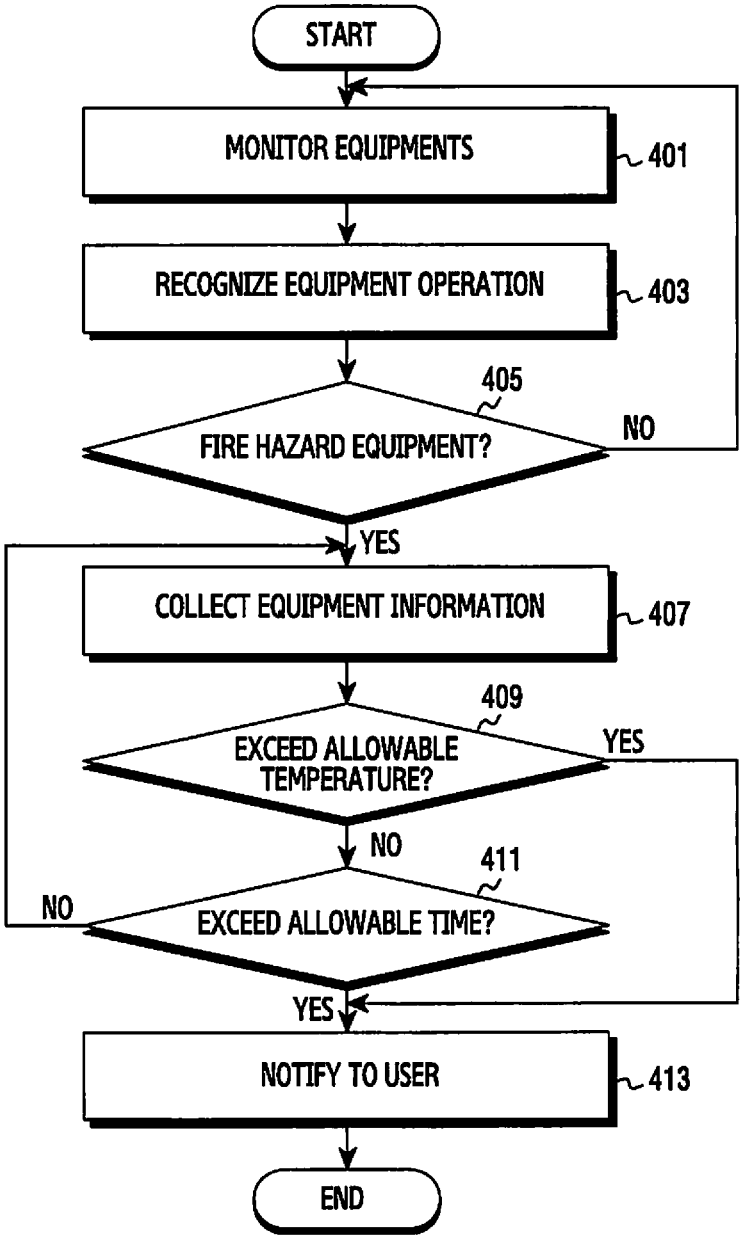
FIG. 4 depicts a method for notifying a fire danger in an electronic device according to an embodiment of the present disclosure.

FIG. 4 depicts a method for notifying a fire danger in an electronic device according to an embodiment of the present disclosure.

Referring to FIG. 4, the electronic device monitors an operation of at least one of equipments in operation 401. For example, the electronic device motors the operation of at least one of the equipments through a motion detector, an IP camera, or a digital thermometer.

The electronic device recognizes the equipment operation in operation 403. The electronic device monitors the equipments connected with the electronic device via a communication network and, when at least one of the equipments operates, detects this. That is, the electronic device determines whether the equipments operate.

In operation 405, the electronic device determines whether the equipment of the detected operation is a fire hazard equipment. For example, a criterion for determining a fire hazard equipment can include heating according to a purpose of the equipment, usability at a high temperature, and heating according to a use condition. When the equipment of the detected operation is not the fire hazard equipment, the electronic device returns to operation 401 and recollects information about at least one operating equipment of the equipments.

When at least one operating equipment of the equipments is the fire hazard equipment, the electronic device collects use information of the equipment in operation 407. The collected information is information for determining a fire danger of the equipment. For example, the collected information can include an allowable temperature of the electronic device, an allowable use duration of the electronic device, and the like.

In operation 409, the electronic device determines whether the fire hazard equipment exceeds a preset allowable temperature. When the fire hazard equipment exceeds the preset allowable temperature, the electronic device informs the user of the fire danger of the fire hazard equipment in operation 413. When the fire hazard equipment does not exceed the preset allowable temperature, the electronic device proceeds to operation 411.

In operation 411, the electronic device determines whether the fire hazard equipment exceeds a preset allowable use duration. When the fire hazard equipment does not exceed the preset allowable use duration, the electronic device returns to operation 407 and repeats the use information collecting of the fire hazard equipment. When the fire hazard equipment exceeds the preset allowable use duration, the electronic device proceeds to operation 413.

In operation 413, the electronic device informs the user of the fire danger of the fire hazard equipment. The electronic device sends a fire danger message of the fire hazard equipment to the user so that the user can recognize the fire danger of the fire hazard equipment. The fire danger message delivery method can represent a Short Message Service (SMS) through the user terminal, a teletext system which offers letter and figure information using a wave blanking interval of a TV broadcasting, and an alarm. In addition, it may be represented as flicker of an indoor light or an alarm. According to an embodiment of the present disclosure, as described above, specific examples where the electronic device sends the fire danger message to the user are described. According to another embodiment of the present disclosure, the electronic device can send the fire danger message to the user in a different method.

Figure 5:
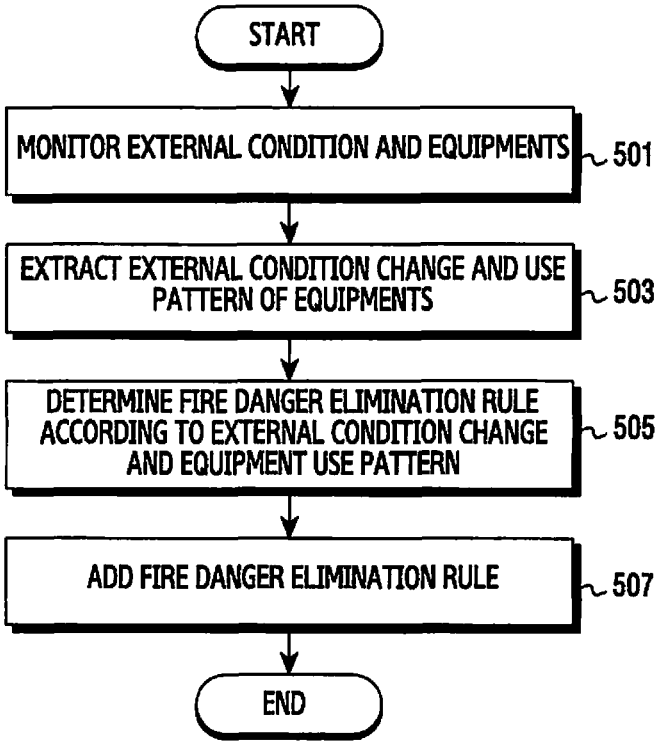
FIG. 5 depicts a method for determining a rule for eliminating a fire danger in an electronic device according to an embodiment of the present disclosure.

FIG. 5 depicts a method for determining a rule for eliminating a fire danger in an electronic device according to an embodiment of the present disclosure.

The electronic device monitors an external condition and equipments in operation 501. For example, the electronic device monitors an operation of at least one of equipments through a motion detector, an IP camera, and a digital thermometer. Referring to FIG. 2, the external condition includes the temperature, the weather, the electricity rate, and the time. The equipments include a refrigerator, an air conditioner, a washing machine, a dryer, an oven, a TV, an LED a switch, a door lock, a motion detector, an IP camera, a digital thermometer, and so on.

In operation 503, the electronic device extracts the external condition change and a use pattern of the equipments. The electronic device analyzes the monitoring results of the external condition and the equipments and thus extracts the external condition change pattern and the use pattern of the equipments.

In operation 505, the electronic device determines a rule for eliminating the fire danger according to the external condition change pattern and the equipment use pattern. The electronic device analyzes the external condition change pattern and the equipment use pattern through a preset algorithm, and thus determines the rule for eliminating the fire danger according to the external condition change pattern and the equipment use pattern. For example, the electronic device analyzes an increase pattern of the temperature and the use pattern of the equipments, finds an interval where the equipments increases the fire danger under the influence of the temperature, and thus determines a rule which lowers the temperature using the air conditioner or turns off the equipments.

In operation 507, the electronic device adds the determined fire danger elimination rule. The electronic device stores the determined fire danger elimination rule in a storage unit of the electronic device. The storage unit contains a list of fire danger elimination rules. The electronic device can automatically store the determined fire danger elimination rules in the list. Also, the list can be added or deleted by the user. That is, the list can be set by the user.

Figure 6:
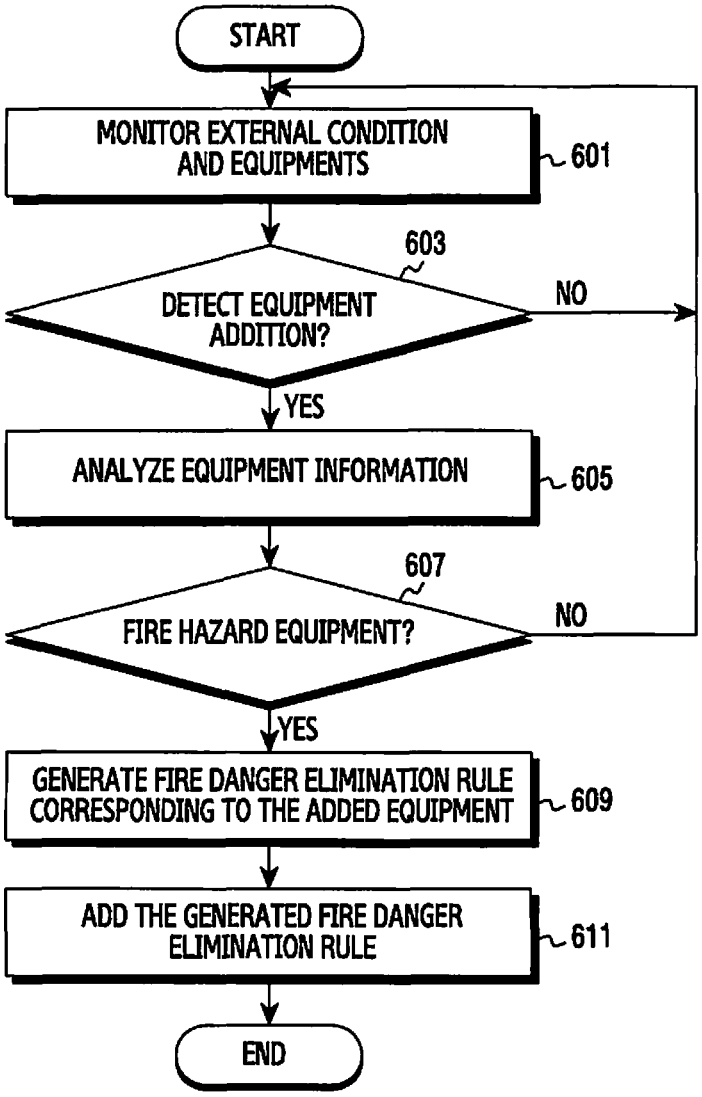
FIG. 6 depicts a method for adding a rule for eliminating a fire danger with respect to an equipment additionally connected, in an electronic device according to an embodiment of the present disclosure.

FIG. 6 depicts a method for adding a rule for eliminating a fire danger with respect to an equipment additionally connected, in an electronic device according to an embodiment of the present disclosure.

In operation 601, the electronic device monitors an external condition and equipments. That is, the electronic device monitors a change of the external condition and an operation of the equipments. For example, the electronic device monitors an operation of at least one of the equipments through a motion detector, an IP camera, and a digital thermometer.

In operation 603, the electronic device detects equipment addition. When detecting the equipment addition, the electronic device analyzes information of the added equipment in operation 605. When not detecting the equipment addition, the electronic device returns to operation 601 and monitors the external condition and the equipments.

Upon detecting the equipment addition, the electronic device analyzes equipment information in operation 605. The electronic device analyzes information of the added equipment.

In operation 607, the electronic device determines a fire danger of the added equipment. The electronic device determines whether the added equipment is a fire hazard equipment by analyzing the information of the added equipment through a preset algorithm. For example, a criterion for determining the fire hazard equipment can include heating according to a purpose of the equipment, usability at a high temperature, and heating according to a use condition. The fire danger of the added equipment is determined based on collected information of the added equipment. When determining that the added equipment is the fire hazard equipment, the electronic device goes to operation 609. When determining no fire hazard equipment, the electronic device returns to operation 601.

When determining that the added equipment is the fire hazard equipment, the electronic device determines a rule for eliminating the fire danger of the added equipment in operation 609. The electronic device determines the rule for eliminating the fire danger of the added equipment through a preset algorithm based on information analysis results of the added equipment. For example, the electronic device analyzes whether the added equipment can produce heat according to the temperature, the weather, the use duration, and the use of nearby equipments and thus determines the rule for eliminating the fire danger of the added equipment.

In operation 611, the electronic device adds the determined fire danger elimination rule. The electronic device stores the determined fire danger elimination rule in a storage unit of the electronic device so as to load the rule when the fire danger elimination rule of the added electronic device is necessary. The storage unit contains a list of rules. The electronic device can automatically store or load the rules in the list. Also, the fire danger elimination rule list can be added or deleted by the user. That is, the list can be set by the user.

Figure 7:
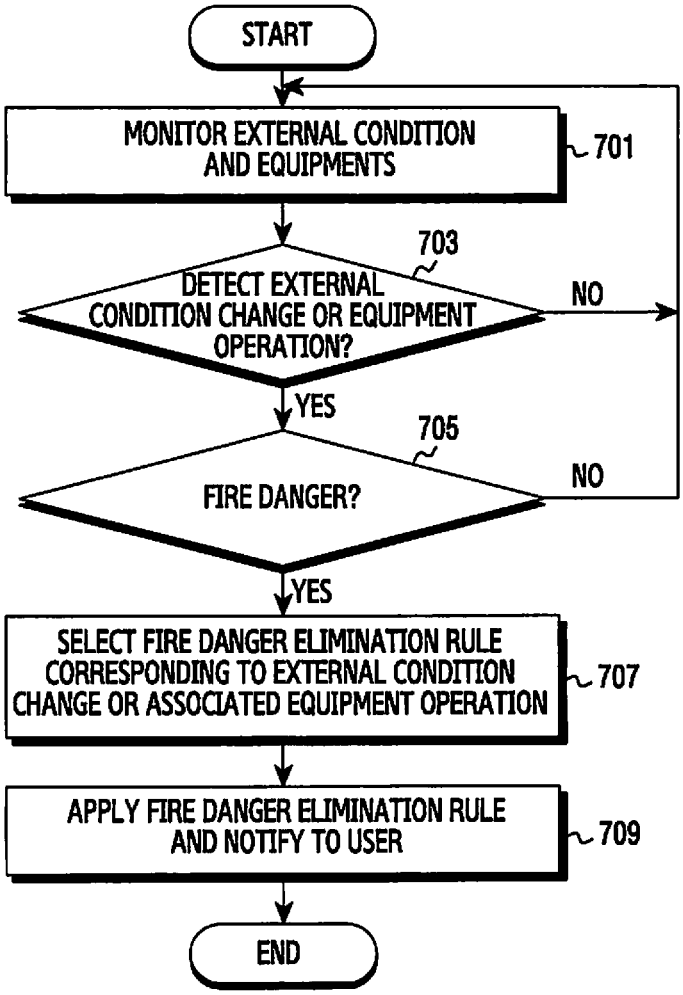
FIG. 7 depicts a method for applying a rule for eliminating a fire danger and notifying to a user according to an external condition change or an operation of equipments in an electronic device according to an embodiment of the present disclosure.

FIG. 7 depicts a method for applying a rule for eliminating a fire danger and notifying to a user according to an external condition change or an operation of equipments in an electronic device according to an embodiment of the present disclosure.

In operation 701, the electronic device monitors an external condition and equipments. For example, the electronic device monitors an operation of at least one of equipments through a motion detector, an IP camera, and a digital thermometer. Referring to FIG. 2, the external condition includes the temperature, the weather, the electricity rate, and the time. The equipments include a refrigerator, an air conditioner, a washing machine, a dryer, an oven, a TV, an LED a switch, a door lock, a motion detector, an IP camera, a digital thermometer, and so on.

In operation 703, the electronic device determines whether the external condition changes or the equipments operate. Referring to FIG. 3, the refrigerator operation can be divided into open refrigerator unit, close refrigerator unit, open freezer, close freezer, temperature up, temperature down, and so on. The air conditioner operation can be divided into ON, OFF, temperature up, temperature down, and so on. The washing machine operation can be divided into ON, OFF, and so on. The dryer operation can be divided into ON, OFF, and so on. The oven operation can be divided into ON, OFF, and so on. The TV operation can be divided into ON, OFF, and so on. The LED operation can be divided into ON, OFF, brighten, darken, and so on. The switch operation can be divided to ON, OFF, and the like. The door lock operation can be divided into open door, close door, and the like. The motion detector operation can be divided into detect motion and the like. The IP camera operation can be divided into detect motion, detect sound, send image, and the like. The digital thermometer operation can be divided to ON, OFF, temperature up, temperature down, and the like. When detecting the external condition change or the operation of the equipments, the electronic device goes to operation 705. When not detecting the external condition change or the operation of the equipments, the electronic device returns to operation 701 and keeps monitoring the external condition and the equipments.

When detecting the external condition change or the operation of the equipments, the electronic device determines a fire danger in operation 705. For example, the fire danger can be determined based on whether the equipment of the detected operation exceeds an allowable temperature or an allowable use duration. The electronic device determines the fire danger by analyzing the external condition change or the operation of the equipments using a preset algorithm. For example, the fire danger can be determined based on heating according to a purpose of the equipment, usability at a high temperature, and heating according to a use condition. When detecting the fire danger, the electronic device goes to operation 707. When detecting no fire danger, the electronic device returns to operation 701 and keeps monitoring the external condition and the equipments.

When detecting the fire danger, the electronic device confirms the fire danger elimination rule corresponding to the external condition change or the equipment operation in operation 707. That is, the electronic device selects a fire danger elimination rule according to the external condition change or the equipment operation through a preset algorithm and loads the rule from a storage unit of the electronic device. For example, the electronic device analyzes an increase pattern of the temperature and the use pattern of the equipments, finds an interval where the equipments increases the fire danger under the influence of the temperature, and thus determines the rule which lowers the temperature using the air conditioner or turns off the equipments.

In operation 709, the electronic device applies the fire danger elimination rule and notifies to the user. The electronic device sends a fire danger message of the fire hazard equipment to the user so that the user can recognize the fire danger of the fire hazard equipment. The fire danger message delivery method can represent an SMS through the user terminal, a teletext system which provides letter and figure information using a wave blanking interval of a TV broadcasting, and an alarm. In addition, it may be represented as flicker of an indoor light or an alarm. According to an embodiment of the present disclosure, as described above, the method of the electronic device for sending the fire danger message to the user is described. According to another embodiment of the present disclosure, the electronic device can send the fire danger message to the user in a different method. The electronic device removes the fire danger by applying the selected fire danger elimination rule. Also, the electronic device informs the user of the fire danger through at least one of user terminals.

Figure 8:
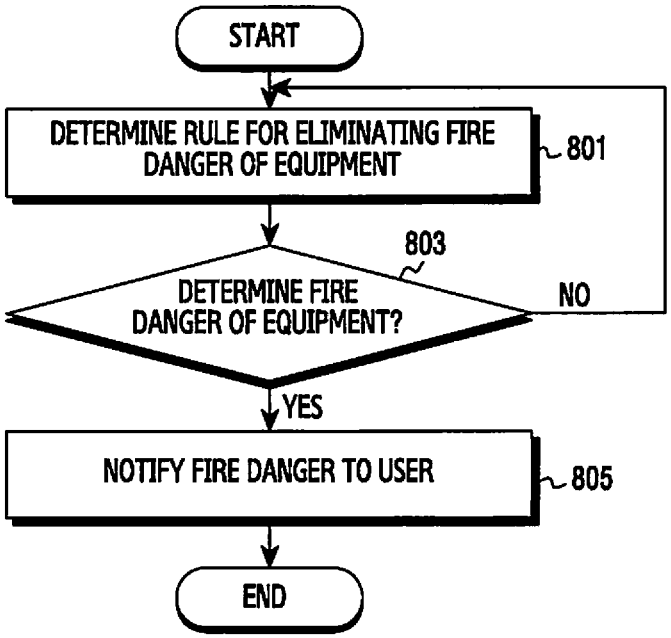
FIG. 8 depicts operations of an electronic device according to an embodiment of the present disclosure.

FIG. 8 depicts operations of an electronic device according to an embodiment of the present disclosure.

Referring to FIG. 8, the electronic device determines a rule for eliminating a fire danger of an equipment in operation 801. The electronic device determines the rule for eliminating the fire danger based on at least one of an external condition change, an equipment operation change, an external condition change pattern, an equipment operation change pattern, and an information analysis result of an added equipment.

In operation 803, the electronic device determines a fire danger of an equipment. When detecting an operation of at least one of existing equipments connected or addition of a new equipment, the electronic device determines a fire danger of the equipment of the detected operation or the added equipment. For example, the fire danger can be determined based on whether the equipment of the detected operation exceeds an allowable temperature or an allowable use duration. Upon detecting the fire danger, the electronic device goes to operation 805.

In operation 805, the electronic device informs a user of the fire danger. The electronic device sends a message to the user so that the user can recognize the fire danger. The fire danger message delivery method can represent an SMS through the user terminal, a teletext system which provides letter and figure information using a wave blanking interval of a TV broadcasting, and an alarm. In addition, it may be represented as flicker of an indoor light or an alarm. According to an embodiment of the present disclosure, as described above, the method of the electronic device for sending the fire danger message to the user is described. According to another embodiment of the present disclosure, the electronic device can send the fire danger message to the user in a different method. The electronic device removes the fire danger by applying the selected fire danger elimination rule. Also, the electronic device informs the user of the fire danger through at least one of user terminals.

Figure 9:
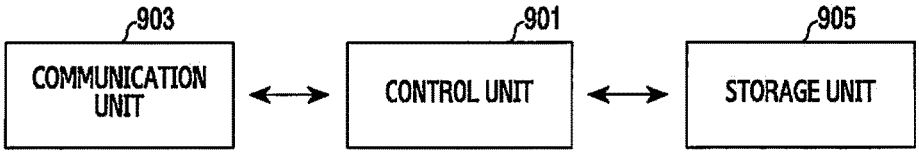
FIG. 9 depicts a block diagram of an electronic device according to an embodiment of the present disclosure.

FIG. 9 depicts a block diagram of an electronic device according to an embodiment of the present disclosure.

A structure of the electronic device of FIG. 9 can be applied to at least one of terminals, equipments, and a gateway. Referring to FIG. 9, the electronic device includes a control unit 901, a communication unit 903, and a storage unit 905.

The communication unit 903 performs a function for processing transmission and reception of wire and/or radio signals of data. When processing radio signal transmission and reception, the communication unit 903 functions to transmit and receive the signals over a radio channel through band conversion and amplification of the signal. When processing wire signal transmission and reception, the communication unit 903 converts a bit string transmitted to other node to a physical signal and converts a physical signal received from other node to a bit sting.

The storage unit 905 stores a microcode and various data of the program for the processing and the controlling of the control unit 901. In particular, the storage unit 905 stores the rules for eliminating the fire danger according to the present disclosure.

The control unit 901 controls the overall operations of the electronic device. For example, the control unit 901 processes and controls data communication. In addition to the typical function, according to an embodiment of the present disclosure, the control unit 901 determines the rule for eliminating the fire danger of at least one equipment capable of communicating with the electronic device, determines the fire danger of the at least one equipment based on the rule, and, when detecting the fire danger, informs the user of the fire danger. For example, the control unit 901 can control to execute the methods of FIG. 4, FIG. 5, FIG. 6, and FIG. 7.

The control unit 901 controls to monitor the equipments connected with the electronic device over the communication network, and, when at least one of the equipments operates, detects the operation. The control unit 901 controls to determine whether the equipment of the detected operation is a fire hazard equipment. The control unit 901 controls to collect information for determining whether at least one operating equipment of the equipments is a fire hazard equipment. The control unit 901 determines a fire danger of at least one operating equipment of the equipments based on the collected information of the at least one operating equipment of the equipments.

When determining that at least one operating equipment of the equipments is the fire hazard equipment, the control unit 901 monitors the use of the equipment and collects the use information of the equipment. The control unit 901 determines whether the fire hazard equipment exceeds the preset allowable temperature. When the fire hazard equipment exceeds the preset allowable temperature, the control unit 901 notifies the fire danger of the fire hazard equipment to the user.

The control unit 901 analyzes the monitoring results of the external condition and the equipments and extracts the external condition change pattern and the use pattern of the equipments. The control unit 901 determines the rule for eliminating the fire danger according to the external condition change pattern and the equipment use pattern. The control unit 901 adds the determined fire danger elimination rule.

When detecting the equipment addition, the control unit 901 controls to analyze the equipment information. The control unit 901 controls to determine a fire danger of the added equipment. The control unit 901 controls to determine a fire danger of at least one operating equipment of the equipments based on the collected information of at least one operating equipment of the equipments. When determining that the added equipment is a fire hazard equipment, the control unit 901 controls to determine a rule for eliminating the fire danger of the added equipment.

According to the present disclosure, the user can recognize a fire danger using the electronics device anytime and anywhere.

The methods according to the embodiments described in the claims or the specification of the present disclosure can be implemented as hardware, software, or a combination of hardware and software.

When implemented as software, a computer-readable storage medium storing one or more programs (software modules) can be provided. One or more programs stored in the computer-readable storage medium are configured for execution by one or more processors in an electronic device. One or more programs include instructions directing the electronic device to execute the methods according to the embodiments described in the claims or the specification of the present disclosure.

While the invention has been shown and described with reference to certain exemplary embodiments thereof, it will be understood by those skilled in the art that various changes in form and details may be made therein without departing from the spirit and scope of the invention as defined by the appended claims and their equivalents.

The invention claimed is:

1. A method for operating an electronic device, the method comprising:

detecting, by a processor of the electronic device, context information of at least one other device;

determining, by the processor, that a fire danger exists in the at least one other device of which the context information is detected;

determining, by the processor, a rule to eliminate the fire danger corresponding to the context information; and controlling, based on the rule, the at least one other device and an external temperature controller to eliminate the fire danger, wherein the context information comprises an external condition of the at least one other device and an operation state of the at least one other device, wherein the rule comprises information indicating a control operation for the at least one other device, wherein the information indicating the control operation for the at least one other device comprises information indicating that temperature control of the external temperature controller is required to eliminate the fire danger of at least one other device, and wherein the rule is determined based on a time, an operating status of the external temperature controller, and the context information.

2. The method of claim 1, further comprising:

removing a power source of the at least one other device in which the fire danger exists.

3. The method of claim 1, wherein the detecting of the context information comprises detecting a change of the external condition and the operation state.

4. The method of claim 1, further comprising:

detecting an additional connection of a device to the electronic device;

analyzing information of the additionally connected device; and determining a rule for eliminating a fire danger of the additionally connected device.

5. The method of claim 1, wherein the determining that the fire danger exists comprises:

if at least one of a temperature or a usage time of the at least one other device exceeds at least one of a preset temperature or a preset usage time, determining that the fire danger exists in the at least one other device.

6. The method of claim 3, further comprising:

extracting a change pattern of the at least one of the external condition or the operation of the at least one other device; and determining the rule based on the change pattern.

7. The method of claim 3, wherein the external condition comprises at least one of a temperature, a weather, an electricity rate, and a time.

8. The method of claim 1, further comprising:

transmitting, by at least one transceiver of the electronic device, a notification of the fire danger to a user equipment (UE).

9. The method of claim 8, wherein the notification comprises:

at least one of a short message service (SMS), a teletext, an alarm sound, or a light.

10. An electronic device comprising:

a processor configured to:

detect context information of at least one other device, determine that a fire danger exists in the at least one other device of which the context information is detected, determine a rule to eliminate the fire danger corresponding to the context information, and control, based on the rule, the at least one other device and an external temperature controller to eliminate the fire danger, wherein the context information comprises an external condition of the at least one other device and an operation state of the at least one other device, wherein the rule comprises information indicating a control operation for the at least one other device, wherein the information indicating the control operation for the at least one other device comprises information indicating that temperature control of the external temperature controller is required to eliminate the fire danger of at least one other device, and wherein the rule is determined based on a time, an operating status of the external temperature controller, and the context information.

11. The electronic device of claim 10, wherein the processor is further configured to:

remove a power source of the at least one other device in which the fire danger exists.

12. The electronic device of claim 10, wherein the processor is further configured to detect a change of the external condition and the operation state.

13. The electronic device of claim 10, wherein the processor is further configured to:

detect an additional connection of a device to the electronic device;

analyze information of the additionally connected device; and determine a rule for eliminating a fire danger of the additionally connected device.

14. The electronic device of claim 10, wherein the processor is further configured to, if at least one of a temperature or a usage time of the at least one other device exceeds at least one of a preset temperature or a preset usage time, determine that the fire danger exists in the at least one other device.

15. The electronic device of claim 12, wherein the processor is further configured to:

extract a change pattern of the at least one of the external condition or the operation of the at least one other device; and determine the rule based on the change pattern.

16. The electronic device of claim 12, wherein the external condition comprises at least one of a temperature, a weather, an electricity rate, and a time.

17. The electronic device of claim 10, further comprising:

at least one transceiver configured to transmit a notification of the fire danger to a user equipment (UE).

18. The electronic device of claim 17, wherein the notification comprises at least one of a short message service (SMS), a teletext, an alarm sound, or a light.

* * * * *